United States Patent [19]

Quinlan, Jr.

[11] Patent Number: 4,576,392

[45] Date of Patent: Mar. 18, 1986

[54] HEIGHT ADJUSTMENT APPARATUS

[75] Inventor: Robert L. Quinlan, Jr., Cuyahoga Falls, Ohio

[73] Assignee: Gerber Products Company, Fremont, Mich.

[21] Appl. No.: 679,166

[22] Filed: Dec. 7, 1984

[51] Int. Cl.[4] ..... A47D 13/04; B62B 7/06

[52] U.S. Cl. ..... 280/87.02 W; 108/119; 297/5; 297/6; 297/56

[58] Field of Search ..... 108/117, 119, 146; 280/87.02 W, 87.05, 649; 297/5, 6, 16, 56, 136, 146, 307, 345

[56] References Cited

U.S. PATENT DOCUMENTS

| | | | |
|---|---|---|---|
| 3,796,430 | 3/1974 | Sudo | 272/70.3 |
| 4,019,756 | 4/1977 | Ishida | 280/649 |
| 4,045,045 | 8/1977 | Boucher et al. | 280/87.02 |
| 4,231,582 | 11/1980 | Moss | 280/87.02 |
| 4,359,242 | 11/1982 | Gerken et al. | 297/5 |
| 4,433,869 | 2/1984 | Payne, Jr. et al. | 297/5 |

*Primary Examiner*—David M. Mitchell
*Assistant Examiner*—Richard M. Camby
*Attorney, Agent, or Firm*—Townsend and Townsend

[57] ABSTRACT

A ratchet-type catch assembly is disclosed for attachment as a slide connection between a scissors frame and an object supported by the frame. While one leg of the scissors frame is fixed to the object in a hinge-type, nonsliding manner and the other in sliding manner, the assembly forms part of the latter, providing a series of locking catches at successively varying angles of the scissors frame, and the discrete graduated heights of the object. The pawl and ratchet stops are oriented to permit vertical elongation of the frame by the application of upward force to the object, while preventing collapse. The catch is opened by release of the pawl, permitting complete collapse of the frame to a flattened configuration.

6 Claims, 6 Drawing Figures

HEIGHT ADJUSTMENT APPARATUS

BACKGROUND OF THE INVENTION

This invention relates to collapsible frame connections, and particularly to catches for locking a vertical collapsible support frame at graduated heights.

Scissors frames are widely used as support structures for tables and other objects, since they can be completely flattened for ease of transport and storage, and many are designed to be extended to various heights to adapt to the particular user or use. Scissors frames are particularly useful in baby furniture, such as baby walkers, playseats, and feeding tables. The flattening is useful in loading the item into an automobile or for general storage, and the height adjustment is frequently needed to accommodate the natural growth of the child.

Existing designs for walkers and the like achieve height adjustment and folding by the use of a knob at the top of one leg of the scissors. The knob is loosened for folding or extension of the scissors to the desired height, then tightened to lock the frame to the table once the height is selected. Problems with its use arise from the fact that the knob is generally positioned beneath the table or armrest to prevent injury to the baby. Accordingly, the person adjusting the height must either reach under the table and manipulate the knob from the bottom, or turn the entire walker up- side-down. In addition, once the frame is extended to its chosen height, one must hold the table in place while tightening the knob to prevent the frame from slipping before it is rigidly secured. These manipulations are time-consuming and awkward, particularly when one must hold a baby at the same time.

SUMMARY OF THE INVENTION

The present invention provides a ratchet-type catch assembly fixed to a slide connection between the moving leg of the scissors frame and the object supported by the frame. The functioning components of the assembly include a releasable pawl and a series of ratchet stops controlling the angle of the scissors frame opening. The frame catches at discreet heights in sequence as the object is raised, with the ratchet stops preventing collapse of the frame as each is engaged successively by the pawl. The pawl is releasable by simple manual compression, permitting complete collapse of the structure. The frame may be fully manipulated with one hand, without being turned upside-down, and without tightening or loosening any knobs. In addition, there is no danger of slippage, and folding and expansion are both done quickly and safely.

In preferred embodiments of the invention, the slide connection is spring loaded to impart resilience to the frame. This is particularly useful for baby furniture such as walkers, feeders and playseats, since it permits bouncing of the table supported by the frame. This feature is common to the prior art and is readily incorporated into the apparatus of the present invention.

DETAILED DESCRIPTION OF THE INVENTION

The drawings depict various views and component parts of a single illustrative embodiment of the present invention. The embodiment is an adaptable multifunction baby device, useful as a walker, feeding table or playseat.

Figure 1:
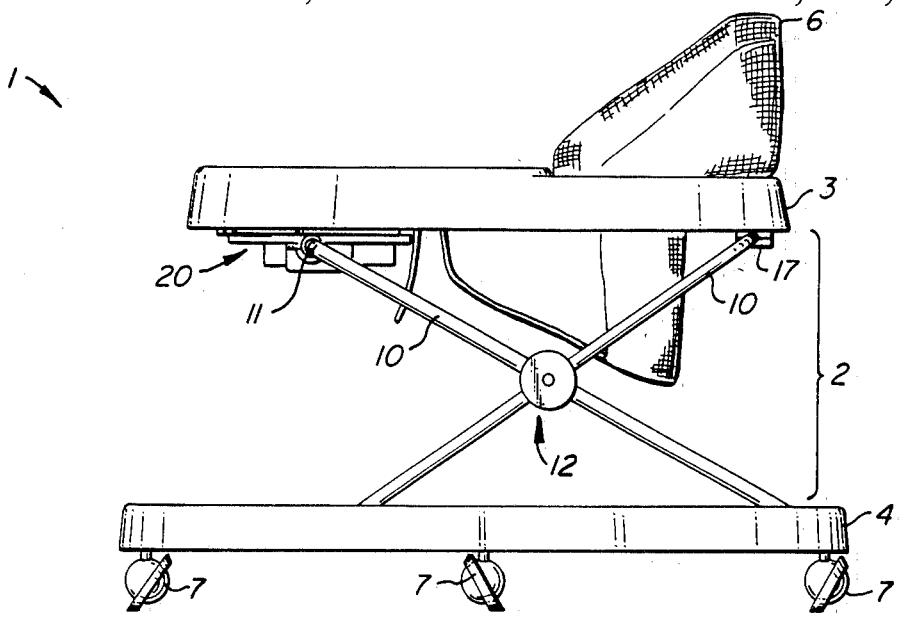
FIG. 1 is a side elevation view of one embodiment of the present invention, as incorporated into the structure of a walker/feeder/playseat designed for baby use.
Figure 2:
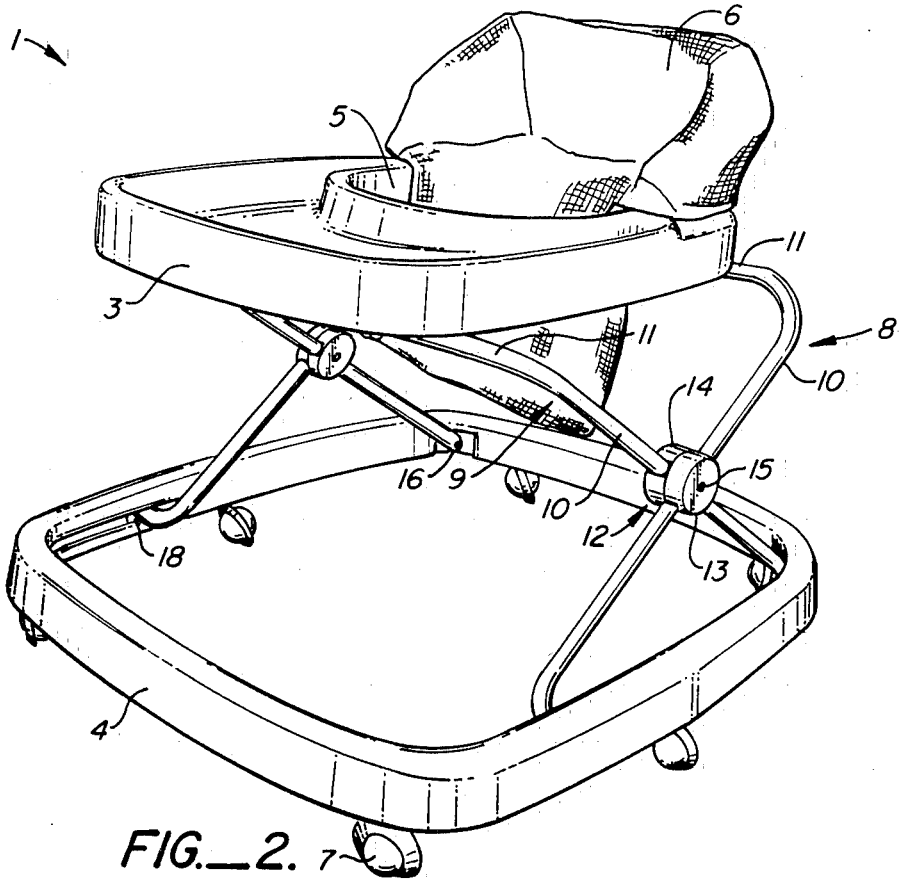
FIG. 2 is a perspective view of the apparatus shown in FIG. 1.

FIGS. 1 and 2 each show the construction of the overall device 1, which includes a scissors frame 2 supporting a raised object, shown as a table 3, above a base frame 4. The table has an opening 5 for passage of the upright torso of the baby for either standing, sitting or walking. A seat 6 is secured to the back of the opening, and may be removable to adapt the device to its various uses. The base frame 4 is open to permit walking, and is set on caster wheels 7 which permit rolling of the device in any direction.

The scissors frame 2 is constructed of a pair of crossed legs 8 and 9, each in the form of an inverted U, consisting of two side portions 10 connected by a crossbar 11. The legs are joined at the center of each side portion at pivot joints 12. Each such joint is constructed of a pair of coaxial cylinders 13 and 14, one leg of the scissors frame passing through each cylinder as shown, the cylinders independently rotatable about a pin 15 passing through the common axis. The frame contains two scissors joined, one at each side of the walker, operating in unison.

The rear leg connections to the table 3 at the top and to the base frame 4 at the bottom are rotatable nonsliding connections. The former is a hinge-type joint 16 at the base of each side portion 10 of the forward-inclined U-leg 9, while the latter is another hinge-type joint 17 along the crossbar 11 of the rearward-inclined U-leg 8. The forward leg connections at both the top and bottom are sliding connections. The connection at the base of each side of the rearwardinclined U-leg 8 is a roller 18 held in a retaining slot 19, which permits forward and backward motion as the frame is lowered and raised, respectively. The connection at the top is the ratchet-controlled catch device 20 of the present invention, which is shown in detail in FIGS. 3 through 6.

Figure 3:
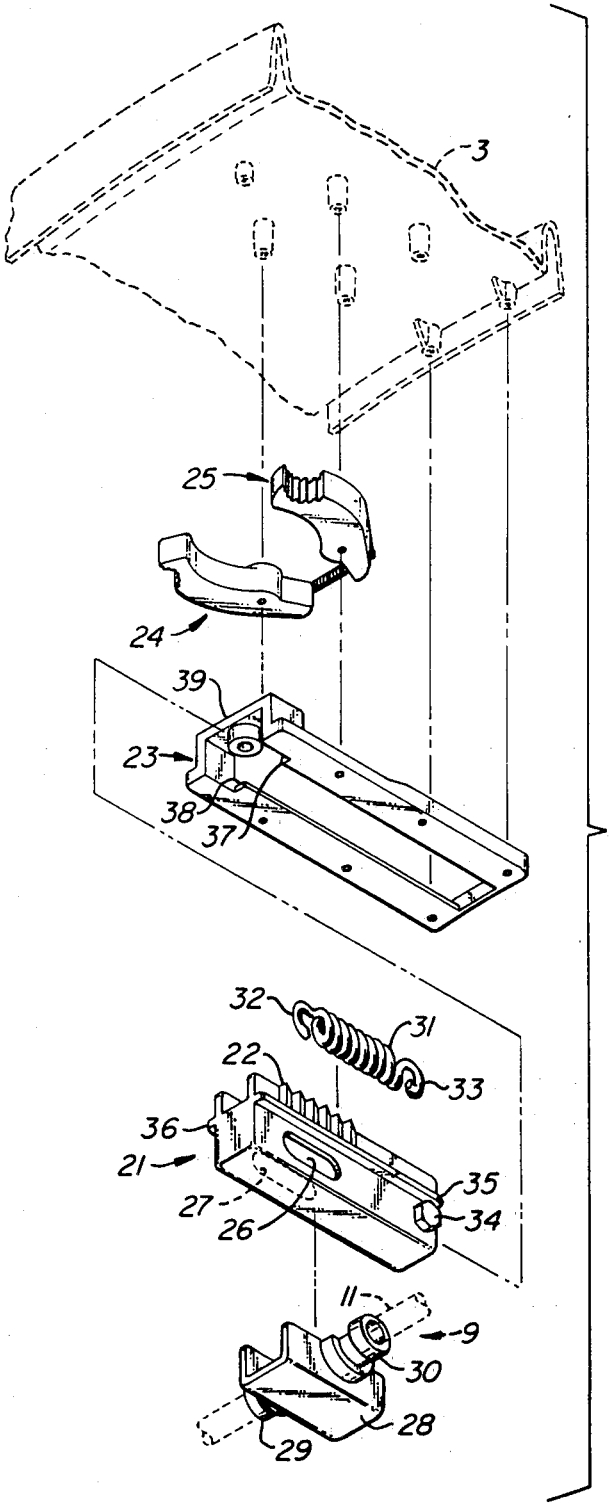
FIG. 3 is an exploded perspective view of the catch assembly which forms part of the structure shown in FIG. 1.

FIG. 3 shows the component parts of the catch assembly are shown. A slide 21 with ratchet stops 22 is secured to the crossbar 11 of the forward-inclined U-leg 9, while a retaining guide 23 is secured in fixed position against the underside of the table 3. As will be clear from the drawings and the discussion which follows, the retaining guide holds the slide against the underside of the table while permitting forward and backward motion. A pair of pawls 24 and 25 engage the ratchet stops 22 on the slide 21, thereby permitting motion of the slide in only one direction unless the pawls are released.

As shown in the lower portion of FIG. 3, the crossbar 11 passes through elongated holes 26 and 27 in each side of the slide 21. The holes 26 and 27 are positioned below the ratchet stops 22 so that the motion of one does not interfere with the other. A slide cover 28 and protective rings 29 and 30 encircle the crossbar 11 at its juncture with the slide 21, to function as shields to prevent the pinching of fingers or other injury to the person manipulating the slide.

An expansion spring 31 is stretched inside the slide 21 in the longitudinal direction, with one end 32 hooked around the crossbar 11 of the U-shaped leg 9, and the other end 33 hooked around a pin 34 inside the slide body toward its rear end.

Figure 4:
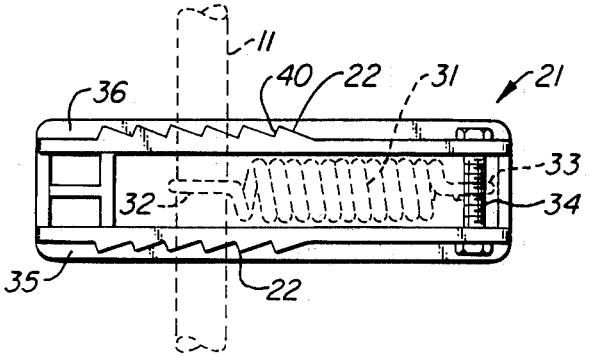
FIG. 4 is a top plan view of the slide portion of the catch assembly shown in FIG. 3.
Figure 5:
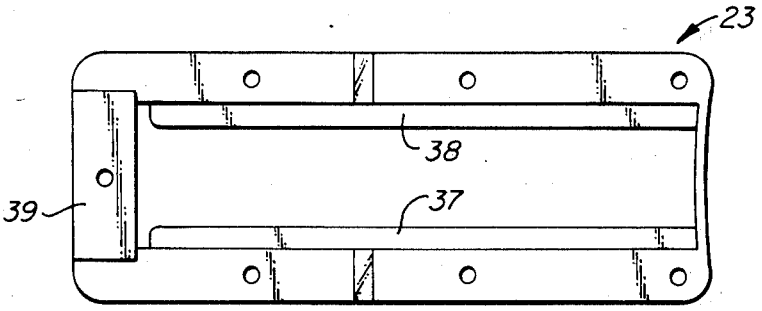
FIG. 5 is a top plan view of the retaining guide portion of the catch assembly shown in FIG. 3.
Figure 6:
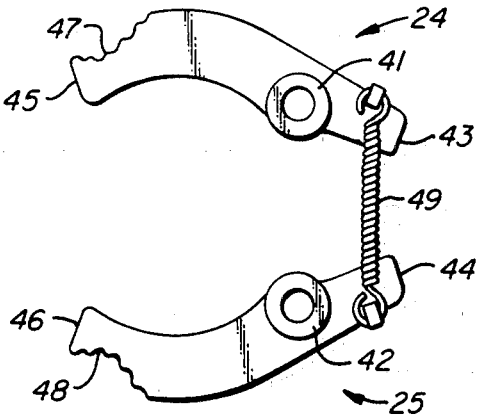
FIG. 6 is a top plan view of the paired pawls shown in FIG. 3.

The pin 34 is more readily visible in FIG. 4, where it is shown as a screw spanning the entire width of the slide. Also shown in this figure is the position of the expansion spring 31 inside the slide 21.

The spring 31 pulls the crossbar 11 against the rear end of the elongated holes 26 and 27, yet permits the crossbar to move forward within the holes while remaining under tension when pressure is exerted downward on the table 3. The spring thus permits the frame to compress slightly when pressure is applied to the table, then returns the frame to its original extension when the pressure is released. This imparts a resilience to the frame, and thus a bouncing capability to the table 3. As mentioned above, the ratchet stops 22 are independent of the elongated holes 26 and 27, so that the pawls 24 and 25 remain fixed in the ratchet stops 22 during the bouncing motion. Thus, the only part of the catch assembly moving forward during the bouncing is the cross-bar 11 of the forward-inclined U-leg 9, as explained further below.

Returning to FIG. 3, a pair of elongated lips 35 and 36 extend outward from the slide 21, one from each side thereof, in the horizontal direction. These are also visible in FIG. 4. The lips are designed to rest on corresponding ledges 37 and 38, respectively, of the retaining guide 23, which are also visible in the top view of the slide shown in FIG. 5. The lips 35 and 36 are capable of sliding along these ledges, their position depending on the angle of the U-leg 9 and thus the height of the table 3 (FIG. 3). The forward end 39 of the retaining guide 23 is raised and open to permit the insertion of the slide 21 during the assembly of the parts.

Returning to FIG. 4, the ratchet stops 22 are arranged on opposite sides of the slide 21, for engagement from both directions simultaneously. The stops are in the form of a row of notches 40 on each side, inclined toward the rear of the structure (i.e., toward the right side of the drawing). The stops are symmetrical about the longitudinal center line of the slide, permitting simultaneous engagement by the paired pawls 24 and 25 shown in FIG. 6.

The rear or inner ends 43 and 44 of the pawls (toward the right side of the drawing) are angled inward to engage the notches which form the ratchet stops. The pawls pivot about pins 41 and 42. The forward ends 45 and 46 (toward the left side of the drawing) of the pawls are equipped with finger grips 47 and 48 for squeezing together to release the rear ends 43 and 44 from the notches 40. The rear ends 43 and 44 are held under tension by an expansion spring 49, which serves to bias these ends inward and thereby lock the pawls into each ratchet stop as the slide 21 is drawn between the pawls in the longitudinal direction.

In the overall operation of the apparatus, the user may raise the table with one hand while the holding the base down with his foot. As the table is raised, the scissors frame extends vertically, its vertical angles closing with both legs rotating toward the vertical. This causes the crossbar 11 of the forward-inclined U-leg 9 to move backwards, pulling the slide 21 with it. Since the retaining guide 23 is fixed against the underside of the table 3, the lips 35 and 36 of the slide will slide along the ledges 37 and 38 of the retaining guide in the rearward direction. This draws the ratchet stops 22 through the space between the pawls 24 and 25 toward the rear, each notch 40 preventing reverse movement of the slide as the notch is engaged. The table may thus be raised to any of the several regularly spaced heights and will lock into position at each one. No manipulation of any parts is required other than merely lifting the table while holding the base down.

For folding or flattening of the apparatus, the pawls 24 and 25 are opened by merely squeezing together the finger grips 47 and 48 until the notch-engaging ends 43 and 44 clear the notches. The finger grips 47 and 48 are held until the table is lowered completely.

The foregoing description is offered for illustrative purposes only. Numerous modifications and variations will be readily apparent to those skilled in the art, while still falling within the spirit and scope of the invention as claimed hereinbelow.

What is claimed is:

1. A catch assembly for adjustably fixing the height of an object mounted on first and second legs pivotally secured together to form a scissors frame collapsible in a longitudinal direction and attached thereto by a hinge joint at the top of said first leg, said assembly comprising:

a slide pivotally attached to the top of said second leg, and having first and second series of ratchet stops, each said series aligned parallel to said longitudinal direction;

a guide on said object for receiving said slide and permitting sliding thereof along said longtiudinal direction;

first and second pawls pivotally attached to aid object and biased to engage said first and second series of ratchet stops, respectively, from opposite sides of said slide and to limit the motion of said slide in the direction away from said hinge joint; and a handle extending backward from the rear of each of said first and second pawls to permit simultaneous release of said pawls by squeezing said handles together.

2. A catch assembly in accordance with claim 1 in which each said series of ratchet stops is comprised of a row of notches inclined toward said hinge joint.

3. A catch assembly in accordance with claim 1 in which said ratchet stops in each said series thereof are spaced at regular intervals.

4. A catch assembly in accordance with claim 2 in which said notches in each said series are spaced at regular intervals.

5. A catch assembly in accordance with claim 1 further comprising a spring extended between said slide and said top of said second leg to permit forward motion of said top of said second leg relative to said slide under tension.

6. In a height adjustable walker comprising a base frame with castered wheels, and a table having a central opening and supported above said base frame by a pair of inverted U-shaped legs joined at each side thereof in a scissors joint, said pair of legs consisting of a forward-inclined leg and a rearward-inclined leg, said forward-inclined leg attached to said base frame by a nonsliding hinge joint and to said table by a first sliding hinge joint, and said rearward-inclined leg attached to said table by a nonsliding hinge joint and to said base frame by a second sliding hinge joint, the improvement in which said first hinge joint is comprised of:

a slide pivotally attached to the top of said forward-inclined leg, and having first and second series of ratchet stops aligned parallel to said scissors joints;

a guide affixed to the underside of said table for receiving said slide and permitting sliding thereof in the direction parallel to said scissors joints;

first and second pawls pivotally attached to the underside of said table, and biased to engage said first and second series of ratchet stops, respectively, from opposite sides of said slide and to limit the motion of said slide in the forward direction; and first and second handles extending from said first and second pawls, respectively, to permit simultaneous release of said first and second pawls by squeezing said handles together.

* * * * *